US010697686B2

(12) United States Patent
Braidotti Cavalari

(10) Patent No.: US 10,697,686 B2
(45) Date of Patent: Jun. 30, 2020

(54) CONSTRUCTIVE LAYOUT APPLIED TO ICE TRAY

(71) Applicant: Nely Cristina Braidotti Cavalari, Bauru (BR)

(72) Inventor: Nely Cristina Braidotti Cavalari, Bauru (BR)

( * ) Notice: Subject to any disclaimer, the term of this patent is extended or adjusted under 35 U.S.C. 154(b) by 287 days.

(21) Appl. No.: 15/795,332

(22) Filed: Oct. 27, 2017

(65) Prior Publication Data

US 2019/0041114 A1 Feb. 7, 2019

(30) Foreign Application Priority Data

Aug. 2, 2017 (BR) ..... 20 2017 016643

(51) Int. Cl.
*F25C 1/243* (2018.01)
*F25C 1/04* (2018.01)

(52) U.S. Cl.
CPC ..... *F25C 1/243* (2013.01); *F25C 1/04* (2013.01); *F25C 2400/06* (2013.01)

(58) Field of Classification Search
CPC ..... F25C 1/243; F25C 1/04; F25C 2400/06; F25C 1/22
See application file for complete search history.

(56) References Cited

U.S. PATENT DOCUMENTS 225,621 A * 3/1880 Ligowsky ..... F41J 1/01 273/363
931,497 A * 8/1909 Schille ..... B65D 43/00 220/252
1,034,580 A * 8/1912 Buckau ..... B29C 43/00 425/408
1,348,134 A * 7/1920 Barnstead ..... A47F 5/0037 248/134
1,698,332 A * 1/1929 Henning ..... A23G 9/08 62/4
1,970,128 A * 8/1934 Collins ..... A24F 19/0057 220/252
2,152,467 A * 3/1939 Crosby ..... F25D 3/08 62/530
2,247,018 A * 6/1941 Henning ..... F25C 1/24 249/119
2,317,067 A * 4/1943 Knaust ..... B65D 85/78 229/117.12
2,812,551 A * 11/1957 Chupa ..... B29C 33/0038 264/503
D185,302 S * 5/1959 Mitzenmacher ..... D1/105
2,946,207 A * 7/1960 Hulterstrum ..... A23G 9/00 249/92
D188,992 S * 10/1960 Morrison ..... D7/672
(Continued)

FOREIGN PATENT DOCUMENTS

BR 102015025211 4/2017
CN 204027112 U 12/2014

*Primary Examiner* — Ljijana V. Ciric
(74) *Attorney, Agent, or Firm* — Schmeiser, Olsen & Watts, LLP

(57) ABSTRACT

An ice tray is provided, which includes a tray used to obtain pieces of ice with spherical geometry. The ice tray includes a base and a cover, provided with a first and a second semi-spherical cavity, respectively, which connect to form a spherical cavity, appropriately suitable for obtaining spherical geometric pieces of ice.

10 Claims, 9 Drawing Sheets

(56) References Cited

U.S. PATENT DOCUMENTS 2,955,044 A * 10/1960 Tupper ..... A23G 9/221 426/515
2,961,850 A * 11/1960 Tupper ..... F25C 1/243 249/126
2,980,039 A * 4/1961 Jolly ..... B65D 85/78 249/97
3,020,730 A * 2/1962 Harris, Sr. ..... F25C 1/18 62/307
3,070,275 A * 12/1962 Bostrom ..... B65D 51/28 229/4.5
3,091,194 A * 5/1963 Dickinson ..... A23G 9/083 426/249
3,113,667 A * 12/1963 Knapp ..... B65D 85/30 206/523
3,161,031 A * 12/1964 Flannery ..... F25D 3/08 62/457.4
3,197,058 A * 7/1965 Hale ..... B65D 1/36 220/23.6
3,287,807 A * 11/1966 Menke ..... A01J 25/13 425/84
3,306,512 A * 2/1967 Pagnini ..... B65D 85/78 426/135
3,349,941 A * 10/1967 Wanderer ..... B65D 43/021 220/23.88
3,394,861 A * 7/1968 Truax ..... B65D 25/04 229/120.07
3,411,463 A * 11/1968 Moseres ..... A23G 9/26 249/92
3,640,081 A * 2/1972 Hadden ..... F25C 1/10 62/1
3,685,785 A * 8/1972 Brown ..... F25C 1/243 249/129
3,736,767 A * 6/1973 Lukes ..... A23G 9/221 62/349
3,752,433 A * 8/1973 Berman ..... C11C 5/023 249/94
3,780,536 A * 12/1973 Fishman ..... A23G 9/12 62/342
4,076,207 A * 2/1978 Austin ..... A23G 3/0273 249/112
4,081,122 A * 3/1978 Hobson ..... B65D 85/324 206/521.1
4,091,953 A * 5/1978 Daenen ..... A47J 47/02 220/23.86
4,147,324 A * 4/1979 Walter ..... B44C 5/06 249/121
4,157,805 A * 6/1979 Haber ..... A63B 37/00 249/105
4,226,355 A * 10/1980 Helfrich, Jr. ..... A23G 9/288 229/932
4,233,819 A * 11/1980 Stottmann ..... F25C 1/04 165/47
4,239,175 A * 12/1980 Straubinger ..... A23G 9/221 249/121
4,268,002 A * 5/1981 Deveaux ..... B65D 85/72 249/127
4,320,849 A * 3/1982 Yellin ..... A47J 47/02 220/213
4,360,119 A * 11/1982 Olivo ..... B65D 43/0218 206/508
4,372,526 A * 2/1983 Daenen ..... A47G 19/30 206/509
4,550,575 A * 11/1985 DeGaynor ..... A47G 23/04 248/153
4,627,595 A * 12/1986 Rhodes ..... F25C 1/243 220/506
4,638,645 A * 1/1987 Simila ..... F25D 3/08 62/371
D290,539 S * 6/1987 Jennette ..... D34/13
4,762,232 A * 8/1988 Sedutto ..... A23G 9/503 206/525
4,872,586 A * 10/1989 Landis ..... B65D 43/0212 220/781
4,886,239 A * 12/1989 Stimmel ..... F25C 1/243 249/117
4,978,022 A * 12/1990 Weick ..... B65D 43/0212 206/219
4,979,370 A * 12/1990 Hotaling ..... F25C 1/18 62/307
5,184,745 A * 2/1993 Havens ..... A47J 47/02 220/23.83
5,250,315 A * 10/1993 Loew ..... F25C 1/243 426/515
5,344,021 A * 9/1994 Rose ..... B65D 21/045 206/505
5,344,023 A * 9/1994 Cox ..... A47J 47/02 206/508
5,354,191 A * 10/1994 Bobis ..... A23G 9/221 249/92
5,398,908 A * 3/1995 Kienle ..... A47J 43/20 249/121
5,409,126 A * 4/1995 DeMars ..... B65D 21/0219 206/499
5,409,128 A * 4/1995 Mitchell ..... B65D 21/022 206/508
5,433,314 A * 7/1995 Lin ..... A45C 11/005 134/901
5,474,184 A * 12/1995 Mandler ..... A47L 15/4436 206/519
D365,724 S * 1/1996 Yu ..... D7/355
D369,506 S * 5/1996 Tinius ..... D7/355
D369,507 S * 5/1996 Tinius ..... D7/355
5,520,010 A * 5/1996 Altman ..... A23L 3/364 100/195
D375,964 S * 11/1996 Poubouridis ..... D15/136
5,597,500 A * 1/1997 Hasenfratz ..... A47J 36/2483 219/385
D384,960 S * 10/1997 Kistler ..... D15/135
5,775,483 A * 7/1998 Lown ..... B65D 21/0219 206/508
5,787,839 A * 8/1998 Magnant ..... A01K 5/0114 119/51.5
5,851,415 A * 12/1998 Thomas ..... A23G 9/221 249/117
5,858,263 A * 1/1999 Geary ..... B65D 81/383 206/575
6,176,464 B1 * 1/2001 Harvey ..... A63H 33/001 249/126
RE37,213 E * 6/2001 Staggs ..... A47G 19/2288 62/457.3
6,269,964 B1 * 8/2001 Turner, Jr. ..... A47J 36/027 206/564
6,301,919 B1 * 10/2001 Blaustein ..... A23G 9/22 249/120
D457,782 S * 5/2002 Snell ..... D7/396.2
D480,604 S * 10/2003 Lillelund ..... D7/543
D484,745 S * 1/2004 Watson ..... D7/545
D504,286 S * 4/2005 de Cleir ..... D7/675
6,886,694 B2 * 5/2005 McNeeley ..... B65D 21/02 206/505
7,128,230 B2 * 10/2006 Jacobson ..... A47J 31/50 220/4.26
D535,348 S * 1/2007 Sammann ..... D21/398
7,252,280 B2 * 8/2007 Hollands ..... B29C 33/44 249/105
7,510,096 B2 * 3/2009 Wang ..... B65D 21/0219 206/508
7,523,915 B2 * 4/2009 Halpin ..... F41J 9/16 249/168
D623,898 S * 9/2010 Snell ..... D7/509
7,832,586 B2 * 11/2010 Vovan ..... B65D 1/34 220/23.89
7,963,500 B1 * 6/2011 Holiday ..... B29C 39/02 249/117
D661,540 S * 6/2012 Facey ..... D7/354
D677,968 S * 3/2013 Bond ..... D7/325
D684,019 S * 6/2013 Facey ..... D7/354

(56) References Cited

U.S. PATENT DOCUMENTS 8,474,641 B2 * 7/2013 Hays ..... A47G 19/2288 220/23.89
D687,681 S * 8/2013 Barber ..... D7/674
D689,746 S * 9/2013 Zorovich ..... D7/672
D689,747 S * 9/2013 Zorovich ..... D7/672
D693,189 S * 11/2013 Facey ..... D7/354
D693,625 S * 11/2013 Facey ..... D7/354
8,770,431 B1 * 7/2014 Glaser ..... B65D 71/70 220/521
D731,264 S * 6/2015 Frank ..... D7/672
9,771,191 B2 * 9/2017 Loaiza Alvarez .... A47J 36/027
9,869,503 B1 * 1/2018 Saeks ..... F25C 1/24
10,245,522 B1 * 4/2019 Williams ..... A63H 33/001
2005/0064069 A1 * 3/2005 Adams ..... A23L 2/385 426/66
2005/0202138 A1 * 9/2005 Kazich ..... A23G 9/503 426/421
2007/0107447 A1 * 5/2007 Langlotz ..... F25C 1/243 62/66
2007/0262230 A1 * 11/2007 McDermott, Jr. ..... F25C 1/22 249/126
2009/0088273 A1 * 4/2009 Nardacci ..... A63B 37/0004 473/379
2009/0158755 A1 * 6/2009 Cutting ..... A01N 1/02 62/66
2012/0237656 A1 * 9/2012 Henry ..... A47J 37/01 426/512
2013/0011530 A1 * 1/2013 Wolf ..... A23G 9/26 426/241
2014/0137576 A1 * 5/2014 Culley ..... F25C 1/25 62/71
2014/0165610 A1 * 6/2014 Boarman ..... F25C 1/22 62/3.63
2014/0165618 A1 * 6/2014 Culley ..... F25C 1/25 62/71
2014/0165619 A1 * 6/2014 Culley ..... F25C 1/18 62/71
2015/0021458 A1 * 1/2015 Zorovich ..... B29C 33/0038 249/134
2015/0107275 A1 * 4/2015 Papalia ..... F25C 1/18 62/67
2016/0216020 A1 * 7/2016 Safrin ..... F25C 1/04
2016/0341461 A1 * 11/2016 Williams ..... F25C 1/243
2018/0304167 A1 * 10/2018 Jones ..... A63H 33/001

* cited by examiner

CONSTRUCTIVE LAYOUT APPLIED TO ICE TRAY

CROSS-REFERENCE TO RELATED APPLICATIONS

This application claims priority to Brazilian Application No. 20 2017 016643-6, having a filing date of Aug. 2, 2017, the entire contents of which are hereby incorporated by reference.

FIELD OF TECHNOLOGY

This following deals with an object contained in the field of household utensils, particularly utensils used to obtain pieces of ice.

It is a device with the function of obtaining pieces of ice with spherical geometry and appropriate for stacking, which attribute to the product a unique and distinctive character before its congeners.

BACKGROUND

As is widely known in the consumer market in general, Brazil has a great demand for ice trays, due to the predominance of high temperatures during most of the year. In these warmer periods, the consumer is looking for alternatives to appease the effects of heat, especially by using ice to conserve drinks at low temperatures.

In recent years, the market has come to require coverable trays for producing pieces of ice in a variety of shapes, in contrast to conventional cubes or chips. However, the State of the Art still lacks practical, efficient and inexpensive solutions to obtain spherical geometric pieces of ice, especially in domestic environments.

The utility model patent document CN204027112 discloses a silica gel form to obtain spherical pieces of ice. However, the bulged shape of the base of the tray/mold precludes its stacking, so that embodiments of the reference do not optimize the space used. Still, the reference features tabs in formats that do not guarantee practical handling by the user. Finally, the said document does not carry out the detailed description of all its elements, so that reproduction of embodiments of the reference by a person skilled in the art is compromised.

The utility model patent document BR102015025211-0 relates to a substantially square ice tray for obtaining spherical pieces of ice. Having substantially different constructivity in relation to embodiments of the present invention, this priority does not solve the adversity of stacking the trays, since the tray does not have the necessary means for safe and efficient stacking.

Thus, it is envisaged that the prior art and the consumer market would benefit from the introduction of a form for obtaining spherical geometric ice, of simple manufacture and practical handling, suitable to be stacked safely and efficiently.

SUMMARY

An aspect relates to an ice tray, which has a constructive arrangement where a base and a cover, both fit with semispherical cavities, are connected for the formation of a spherical cavity, appropriately suitable for obtaining pieces of ice with spherical geometry.

The said ice tray also has, in the region of the cover, two diametrically opposite flaps, which both facilitate the withdrawal of the piece of ice from the present utility model and also serve as support for safe and efficient stacking of the trays.

BRIEF DESCRIPTION

Some of the embodiments will be described in detail, with reference to the following figures, wherein like designations denote like members, wherein.

DETAILED DESCRIPTION

Figure 1:
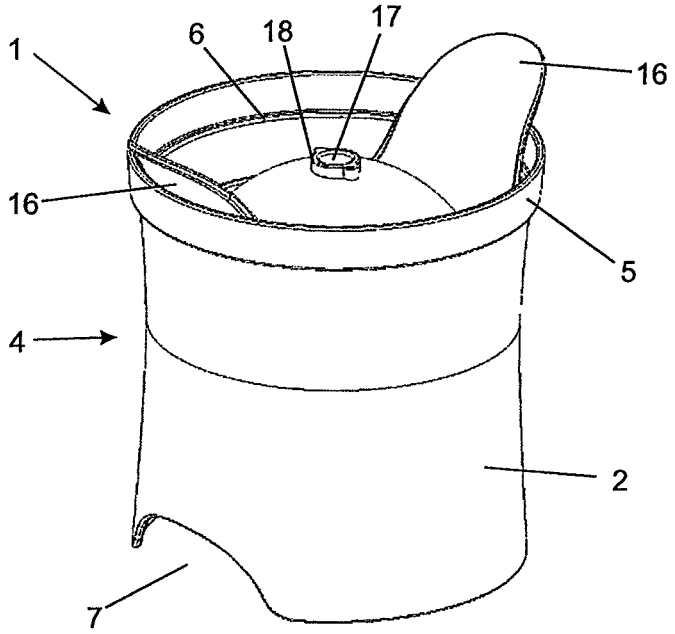
FIG. 1 shows a perspective view of an ice tray according to an embodiment.
Figure 2:
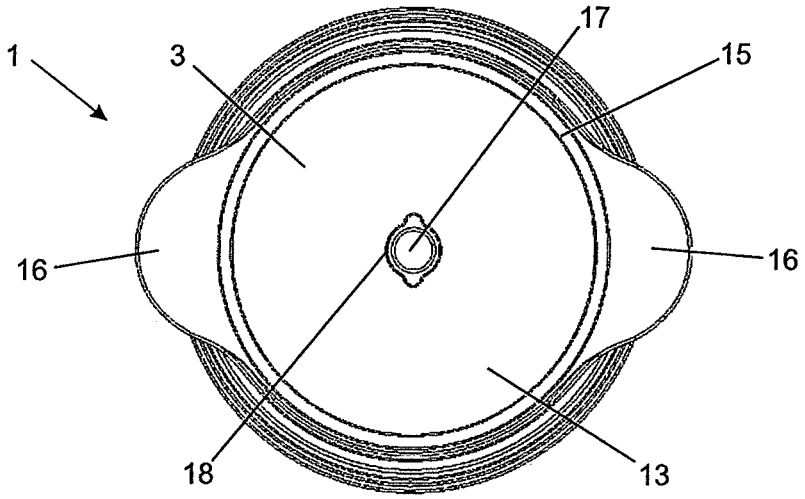
FIG. 2 shows a top view of the ice tray.
Figure 3:
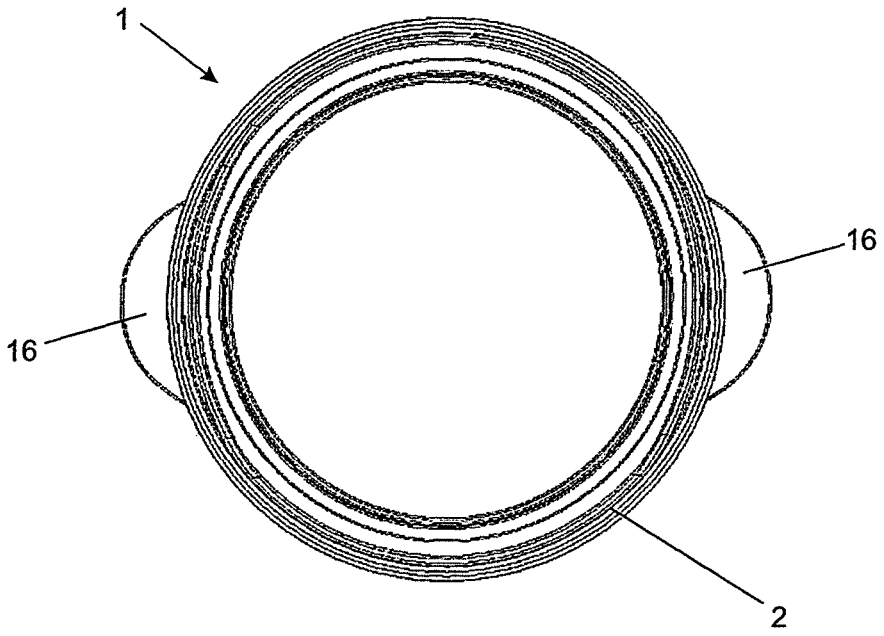
FIG. 3 shows a lower view of the ice tray.
Figure 4:
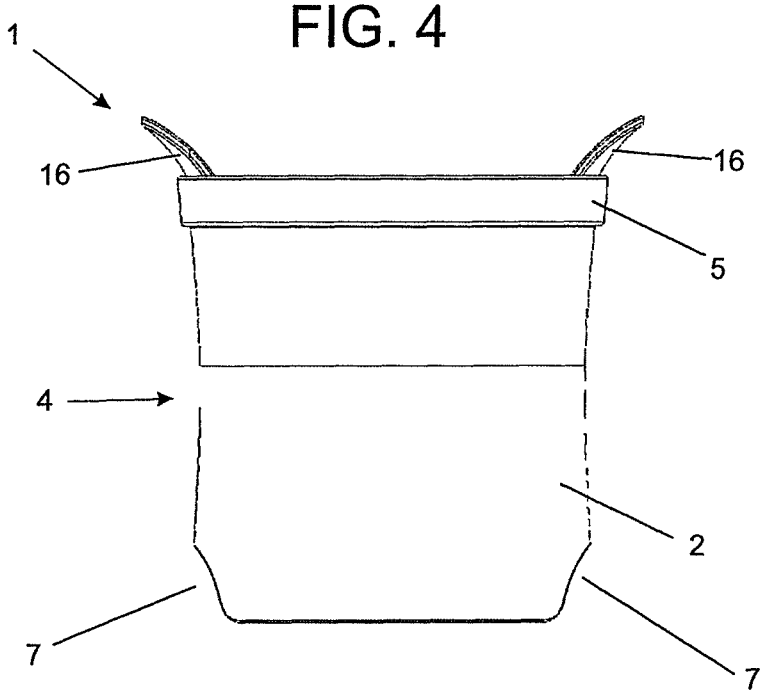
FIG. 4 shows a front view of the ice tray.
Figure 5:
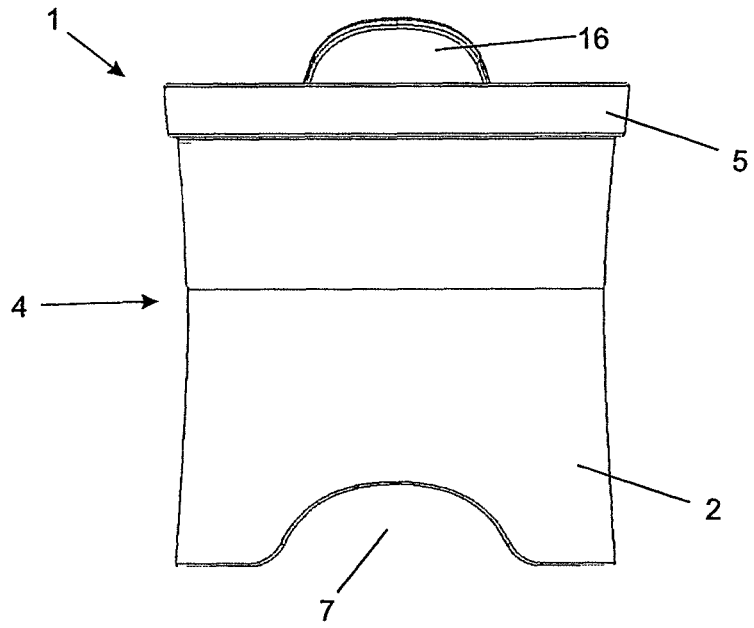
FIG. 5 shows a side view of the ice tray.
Figure 6:
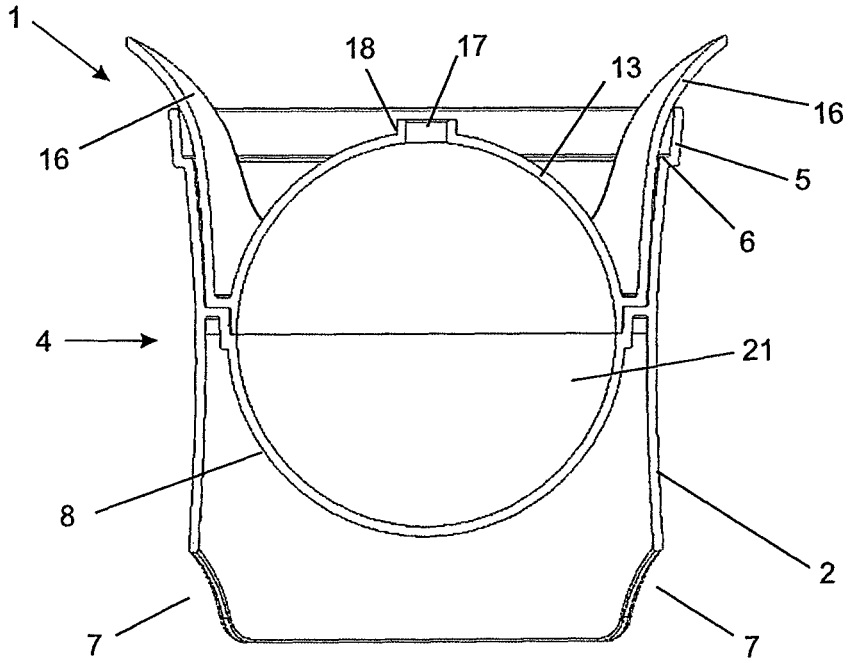
FIG. 6 shows a front cross-sectional view of the ice tray.
Figure 7:
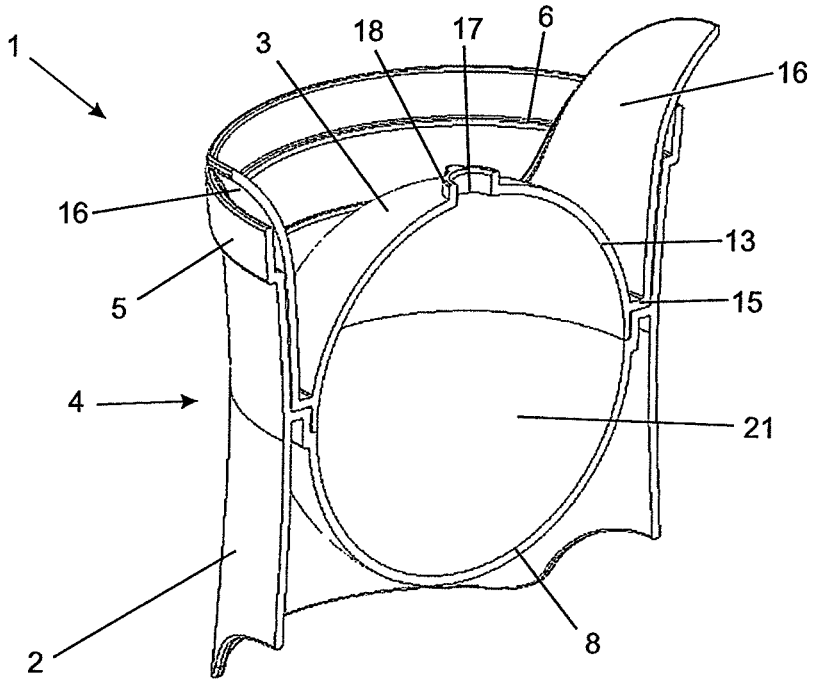
FIG. 7 shows a cutaway perspective view of the ice tray.
Figure 8:
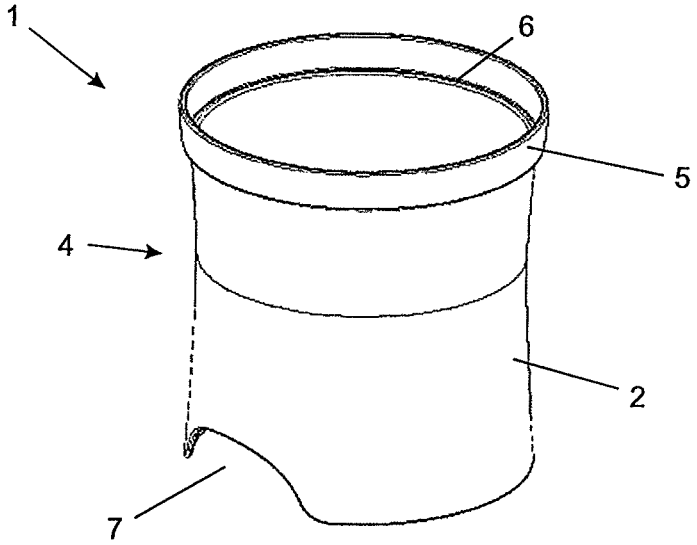
FIG. 8 shows a perspective view of a base of an ice tray according to an embodiment.
Figure 9:
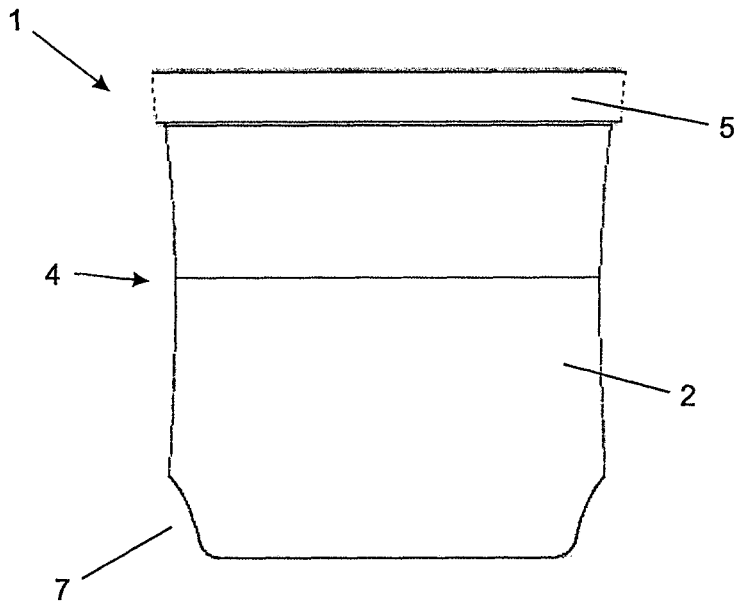
FIG. 9 shows a front view of the base.
Figure 10:
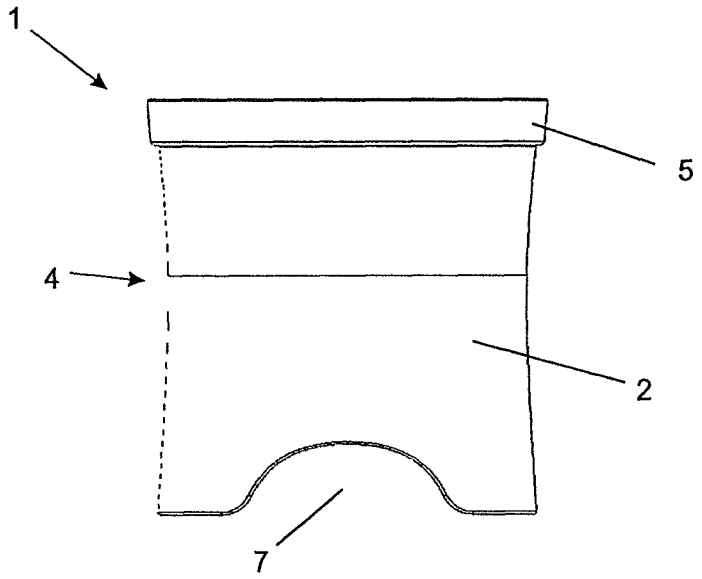
FIG. 10 shows side view of the base.
Figure 11:
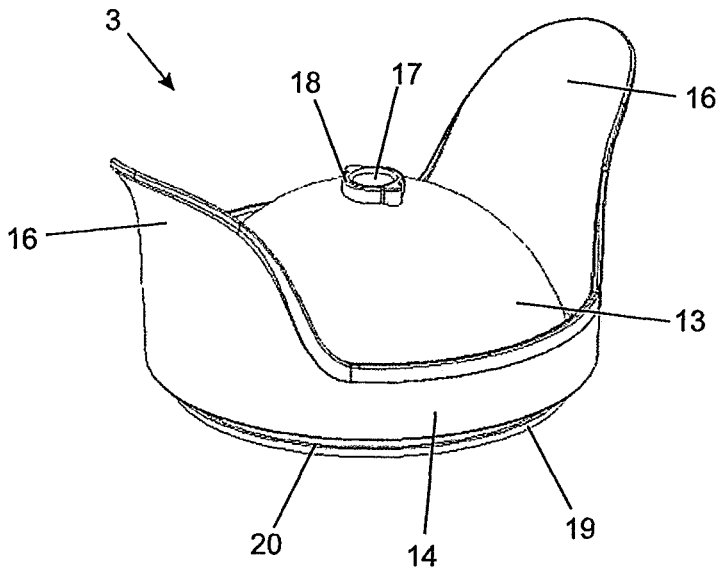
FIG. 11 shows a perspective view of a cover of an ice tray according to an embodiment.
Figure 12:
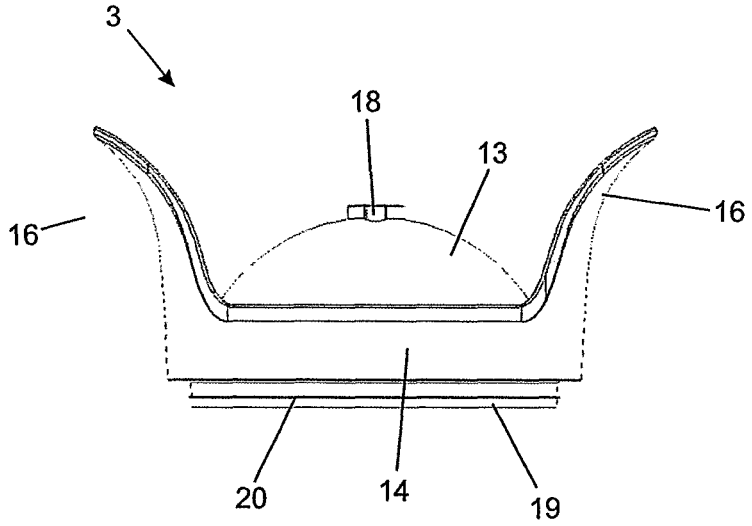
FIG. 12 shows front view of the cover.

According to the above figures, embodiments of this invention "CONSTRUCTION LAYOUT APPLIED TO ICE TRAY", may include an ice tray (1), made of plastic material, which comprises two main parts, being:

(a) a base (2) of substantially cylindrical shape with a central region (4) smoothly bulged and of smaller diameter in relation to lower and upper regions of the base (2); the upper portion of the base 2 is provided with a larger diameter rim 5, which defines a step 6; the lower portion of the base (2) is provided with two semicircular recesses (7) on the sides and diametrically opposite; inside, the base (2) has a first semispherical cavity (8), connected to the walls of the base (2) by means of an intermediate region (9), which defines a first flat region (10), a second flat region (11) and at least one surrounding groove (12);

(b) a cover (3) with a central region provided with a second semispherical cavity (13); the cover is provided with a surrounding ring (14) positioned externally to the second semispherical cavity (13); a third flat region (15) is defined between the second semispherical cavity (13) and the surrounding ring (14) of the cover (3); the surrounding ring (14) of the cover (3) has two diametrically opposed tabs (16) with a saddle-shaped curvature projected toward the outer region parallel to the semicircular recesses (7) of the base (2); in the upper portion of the second semispherical cavity (13), the cover (3) has a hole (17) surrounded by a circular elevation (18); in its lower portion, the cover (3) has a lower ring (19) provided with at least one surrounding elevated rim (20).

Figure 13:
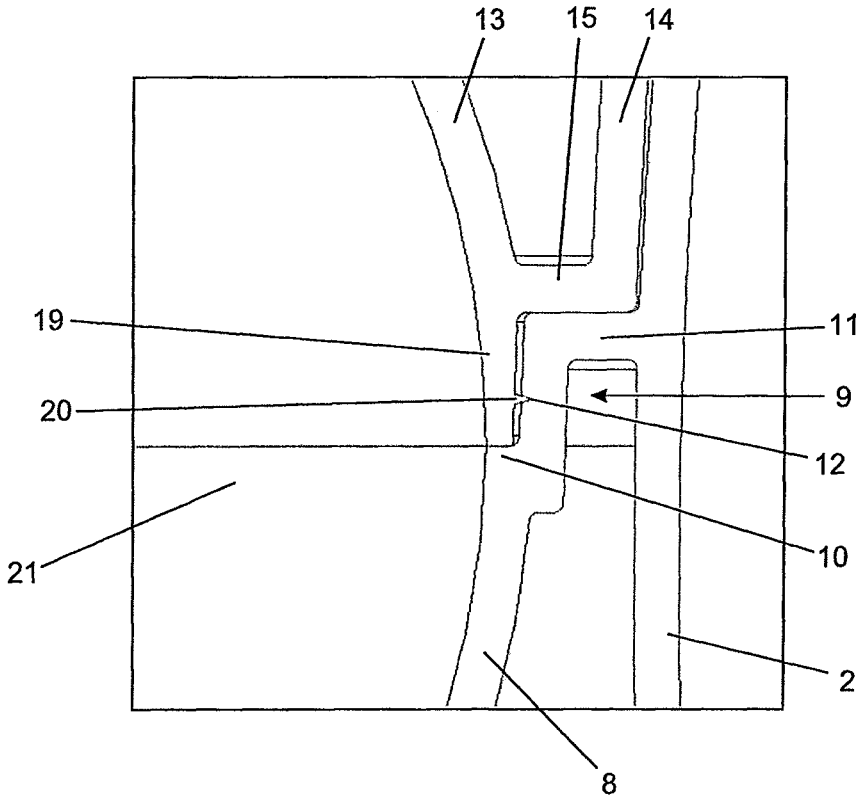
FIG. 13 shows a cross-sectional view of a connection between a base and a cover of an ice tray according to an embodiment.
Figure 14:
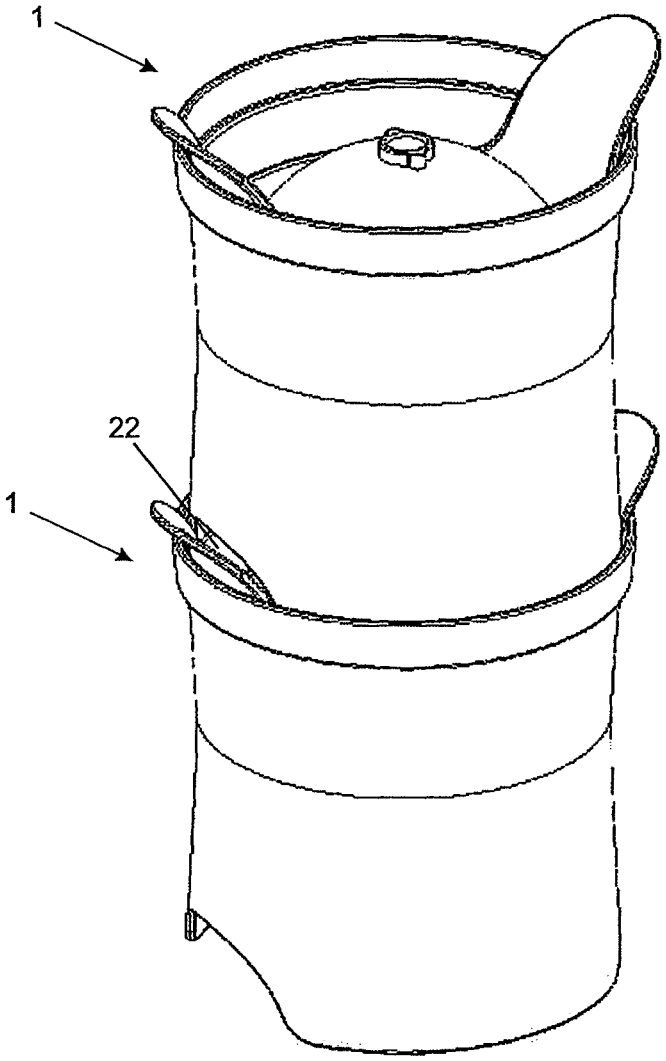
FIG. 14 shows a perspective view of stacked ice trays according to an embodiment.
Figure 15:
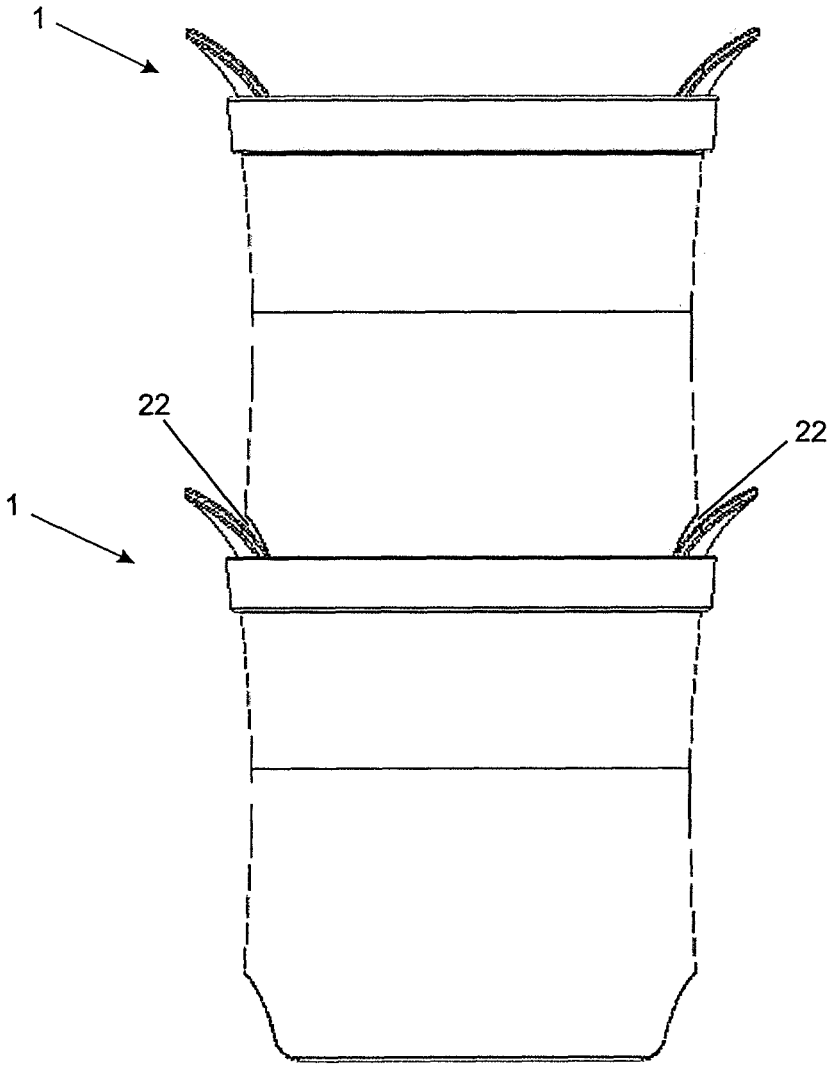
FIG. 15 shows a front view of the stacked ice trays.

The engagement between the base (2) and the cover (3) occurs by means of a connection between the surrounding elevated rim (20) of the cover (3) and the surrounding groove (12) of the base (2), as shown in detail in FIG. 13. Besides, it is noted that the third flat region (15) rests against the second flat region (11) and the lower end of the lower ring (19) rests against the first flat region (10), ensuring a perfect fit between the elements of the tray (1) and the correct geometry of the piece of ice obtained from the present utility model. The connection between the base (2) and the cover (3) results in a connection between the first (8) and the second (13) semispherical cavities, which give rise to a spherical cavity (21), the purpose of which is to form pieces of ice with spherical geometry.

The hole (17) of the cover (3), surrounded by a circular elevation (18), has two functions. On the one hand, the hole (17) acts as a means for the inflow of liquids, which fill the spherical cavity (21) formed by the coupling of the first (8) and the second (13) semispherical cavities, originated by means of the connection between the cover (3) and the base (2). On the other hand, the hole (17) is responsible for directing and outputting any excess liquid deposited in the spherical cavity (21).

The withdrawal of the spherical geometric piece of ice is carried out by simultaneously pressing the flaps (16) radially towards the center of the tray (1), so as to disengage the surrounding projection (20) and the surrounding groove (12). Thereafter, the cover (3) is removed and finally the piece of ice is removed from the tray (1). Advantageously, the saddle-shaped flaps (16) of the cover (3) conform to the user's fingers, while the slightly bulged shape of the central region (4) of the base (2) allows it to conform to the user's hand, facilitating the removal of the piece of ice from this utility model.

Another aspect of the present ice tray (1) is that it is suitable for stacking, optimizing the space occupied in its transport, storage and use. The flaps (16) of the cover (3) and the semicircular recesses (7) of the base (2) correspond to each other and are connected when two or more ice trays (1) are stacked. However, the connection between the flaps (16) and the semicircular recesses (7) has been designed to create a gap (22), suitable for the circulation of convective currents between the ice trays (1). The gaps (22) assist and promote the solidification of the liquid stored inside the spherical cavities (21) of the trays (1) and the consequent formation of spherical geometric pieces of ice. Further, the step (6) acts as a support for the front and rear portions of the stacked trays (1), complementing the support of the side portions provided by the flaps (16).

Although the present invention has been disclosed in the form of preferred embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

The invention claimed is:

1. A stackable ice tray, suitable for forming pieces of ice with a spherical geometry, comprising:

a substantially cylindrical base having an upper region, lower region, and central region, wherein a first semispherical cavity is located in the central portion, and wherein the lower portion has two semicircular recesses on diametrically opposite sides of the base;

a cover having a second semispherical cavity and a surrounding ring positioned externally to the second semispherical cavity, wherein the surrounding ring of the cover has two diametrically opposed tabs projecting from the cover;

wherein the first and second semispherical cavity connect to form a single spherical cavity capable of holding water when the cover is placed onto the base.

2. The stackable ice tray of claim 1, wherein the two diametrically opposed tabs projecting from the cover may engage two semicircular recesses of a lower portion of a second stackable ice tray of the same design.

3. The stackable ice tray of claim 2, wherein engagement between the two diametrically opposed tabs from the cover and the two semicircular recesses of the lower portion of the second stackable ice tray creates a gap suitable for the circulation of convective currents between the stackable ice tray and the second stackable ice tray.

4. The stackable ice tray of claim 2, wherein the upper portion of the base has a rim comprising a step and the step acts as a support for front and rear sides of a lower portion of a base of the second stackable ice tray, wherein the front and rear sides are the sides not including the two semicircular recesses.

5. The stackable ice tray of claim 1, wherein the central portion of the base has a smaller circumference than the upper portion and the lower portion.

6. The stackable ice tray of claim 1, wherein the two diametrically opposed tabs projecting from the cover have a saddle-shaped curvature.

7. The stackable ice tray of claim 1, wherein the cover has a hole surrounded by a circular elevation.

8. The stackable ice tray of claim 1, wherein the cover is at least substantially inside the base when the cover is placed onto the base and the spherical cavity is formed.

9. The stackable ice tray of claim 8, wherein the two diametrically opposed tabs projecting from the cover extend out of the base.

10. The stackable ice tray of claim 1, wherein pressure applied to the two diametrically opposed tabs projecting from the cover releases the cover from the base.

* * * * *